US009067120B2

(12) United States Patent
Huang

(10) Patent No.: US 9,067,120 B2
(45) Date of Patent: Jun. 30, 2015

(54) TENNIS SCORE DEVICE

(76) Inventor: Su-Er Huang, Feng Yuan (TW)

( * ) Notice: Subject to any disclaimer, the term of this patent is extended or adjusted under 35 U.S.C. 154(b) by 806 days.

(21) Appl. No.: 13/099,600

(22) Filed: May 3, 2011

(65) Prior Publication Data

US 2011/0265707 A1 Nov. 3, 2011

(30) Foreign Application Priority Data

May 3, 2010 (TW) ..... 99208159 U

(51) Int. Cl.
*A63B 71/06* (2006.01)

(52) U.S. Cl.
CPC ..... *A63B 71/0672* (2013.01); *A63B 2243/0083* (2013.01)

(58) Field of Classification Search
CPC ..... A63B 71/0672; A63B 2243/0083; A63B 71/06; A63B 47/00; A63B 71/036; F16L 3/133; F16L 3/24; F16L 3/221; A47G 1/12; A47B 46/005; A47B 67/02
USPC ..... D10/46.1; 116/222–224, 209, 311–318; 248/222.12, 68.1, 74.1, 110, 227.3, 248/230.2, 231.31; 206/315.9; 211/14; 312/321.5; 108/107–108
See application file for complete search history.

(56) References Cited

U.S. PATENT DOCUMENTS 1,625,856 A * 4/1927 Judd ..... 211/14
1,911,256 A * 5/1933 Andrew ..... 224/247
2,024,484 A * 12/1935 Smith ..... 294/146
2,212,129 A * 8/1940 Rust ..... 221/289
3,181,923 A * 5/1965 Guillon et al. ..... 312/351.3
3,280,527 A * 10/1966 Faust ..... 52/301
3,515,092 A * 6/1970 Stengel ..... 116/223
3,529,798 A * 9/1970 Williams et al. ..... 248/469
3,807,675 A * 4/1974 Seckerson et al. ..... 248/73
3,848,844 A * 11/1974 Barrett ..... 248/245
3,873,009 A * 3/1975 Goudreau ..... 224/247
4,062,482 A * 12/1977 Szalony ..... 224/247
D249,573 S * 9/1978 Harris, Jr. ..... D3/224
4,132,187 A * 1/1979 Moebius ..... 116/225
4,172,595 A * 10/1979 Sewell ..... 473/553
4,189,143 A * 2/1980 Van Auken et al. ..... 116/222
D279,959 S * 8/1985 Nimmo et al. ..... D8/396
4,538,784 A * 9/1985 O'Flanagan ..... 248/244
D288,900 S * 3/1987 Gohrig ..... D8/381
4,738,449 A * 4/1988 Droz ..... 473/553

(Continued)

OTHER PUBLICATIONS

Derwent Abstract, CN 201701719 "Tennis Ball Scoring Device, has multiple ball placing blocks equipped with connecting bases and ball placing base that is equipped with sunken ball placing region corresponding to each mark of display surface", published Jan. 12, 2011.*

*Primary Examiner* — R. A. Smith
*Assistant Examiner* — Tania Courson
(74) *Attorney, Agent, or Firm* — Ronald Law Group, LLC

(57) ABSTRACT

A tennis score device includes a body and multiple ball blocks. One end of the long axis of the body is pivotally connected with a supporting rod, so that the body can rotate with respect to the supporting rod. Both sides of the body are formed with an accommodating recess, respectively. Each of the ball blocks has a connecting base and a ball base connected to the corresponding connecting base. Each of the ball blocks are mounted in sequence in the accommodating recesses on both sides of the body via the connecting base. For each of the ball blocks, the side of the ball base opposite to the connecting base has at least one concave ball area for holding a ball.

7 Claims, 8 Drawing Sheets

(56) References Cited

U.S. PATENT DOCUMENTS

| | | | | | |
|---|---|---|---|---|---|
| 4,917,282 | A * | 4/1990 | Hufford | 224/274 |
| 5,040,753 | A * | 8/1991 | Roth | 248/74.2 |
| 5,062,381 | A * | 11/1991 | Hendricks | 116/225 |
| D330,061 | S * | 10/1992 | Hilbert | D34/27 |
| 5,385,113 | A | 1/1995 | Hierath | |
| 5,417,334 | A * | 5/1995 | Wu | 211/70.2 |
| 5,645,177 | A * | 7/1997 | Lin | 211/70.6 |
| 6,578,513 | B1 * | 6/2003 | Niksich | 116/222 |
| D532,197 | S * | 11/2006 | Niksich | D3/221 |
| 7,185,770 | B1 * | 3/2007 | Roten | 211/70.6 |
| 7,267,254 | B2 * | 9/2007 | Perez | 224/666 |
| 7,500,570 | B2 * | 3/2009 | Kurcheski | 211/14 |
| 7,811,500 | B2 | 10/2010 | Gazzara et al. | |
| 7,997,594 | B1 * | 8/2011 | Mortazavi et al. | 280/47.26 |
| 8,246,051 | B1 * | 8/2012 | Nygaard | 273/317 |
| 8,763,821 | B2 * | 7/2014 | Yang et al. | 211/90.02 |
| 8,919,577 | B2 * | 12/2014 | Nally et al. | 211/14 |
| 8,944,111 | B2 * | 2/2015 | Allendorf et al. | 138/106 |
| 2009/0321588 | A1 * | 12/2009 | Sullivan | 248/74.2 |
| 2010/0275458 | A1 * | 11/2010 | Saunders | 34/353 |
| 2012/0138761 | A1 * | 6/2012 | Messinger | 248/226.11 |

* cited by examiner

TENNIS SCORE DEVICE

CROSS-REFERENCE TO RELATED APPLICATIONS

This application claims priority under 35 U.S.C. §119 to Taiwanese patent application 099208159, filed May 3, 2010, the disclosure of which is incorporated herein by reference.

BACKGROUND OF THE INVENTION

1. Field of Invention

The invention relates to a tennis score device and, in particular, to a body with multiple ball blocks that can be replaced individually.

2. Related Art

FIG. 7 shows a conventional tennis score device disclosed in U.S. Pat. No. 5,385,113. It mainly has a supporting body 5 formed by aligning several hollow iron tubes 51. One end of the supporting body 5 is provided with an axis base 51 for pivotally connecting to a supporting bar 52. Both sides of the supporting body 5 are provided with a ball base, respectively. The ball base 4 has several recesses 42 for holding a ball, respectively. Both sides of the supporting body 5 corresponding to the recesses 42 have marks 43. The supporting body 5 is then fixed on the field using the pivotally connected supporting rod 52. The recesses 42 of the ball base 4 are disposed with balls. This then constitutes a score device for the judge, players, and audience to watch scores.

The ball bases 4 on both sides of the supporting body 5 are formed by bending a thin sheet of plastic board 41 and then fixed on the iron tubes 51 of the supporting body 5 using screws 53. As shown in FIG. 8, as the plastic board 41 is bent, the stress accumulates at the bending place 44 on both sides of the recess 42. After long time use or exposure under sunlight, the bending place 44 is likely to crack. Thus, the recess 42 next to the crack of the bending place 44 cannot hold a ball, affecting its scoring function.

Moreover, the ball base 4 is formed by bending an entire sheet of plastic board 41. Once the bending place 44 cracks, the complete plastic board 41 has to be replaced; otherwise, the entire score device would be out of order. This is very inconvenient and wasteful.

Besides, the plastic board 41 of the ball base 4 is fixed to the iron tubes 51 of the supporting body 5 by screws 53. In order for the bent plastic board 41 to be fixed onto the supporting body 5 nicely, many screws 53 have to be used. This causes inconvenience in assembly and replacement.

SUMMARY OF THE INVENTION

To solve the above-mentioned problems, an objective of the invention is to provide a tennis score device that mounts several ball blocks in the accommodating recesses on both sides of the body. The assembly of the score device is very simple. Each individual ball block can be replaced when it is out of order. That is, when the ball area of some ball block is broken, this particular ball block can be replaced without affecting others. This achieves the goals of easy assembly/replacement and low maintenance costs.

Another objective of the invention is to form the body by aluminum extrusion forming. Therefore, the accommodating recesses, the supporting part, and the fixing part can be integrally formed with the body to reduce complications in fabrication. The ball block is manufactured by plastic ejection forming. The connection between the ball base and the ball area is sturdier, rendering a longer lifetime.

To achieve the above-mentioned objectives, the disclosed score device includes: a long rectangular body and a plurality of ball blocks. One end of the long axis of the body has a supporting part for pivotal connection of a supporting bar. The body can rotate with respect to the supporting bar. An accommodating recess is formed on the body on both sides of the supporting part, respectively. Each of the accommodating recesses extends along the long axis of the body. The two side surfaces of the body next to each of the accommodating recesses have a displaying surface, respectively. Each of the displaying surfaces has several marks for score display.

Each of the ball blocks has a connecting base and a ball base connected to the connecting base. Each of the ball blocks is mounted in sequence in the accommodating recesses on both sides of the body via the connecting base. The ball base of each of the ball blocks has at least one concave ball area on the side opposite to the connecting base. Each of the ball areas can hold one ball. Each of the ball areas corresponds to each of the marks on the displaying surface of the body.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

Figure 1:
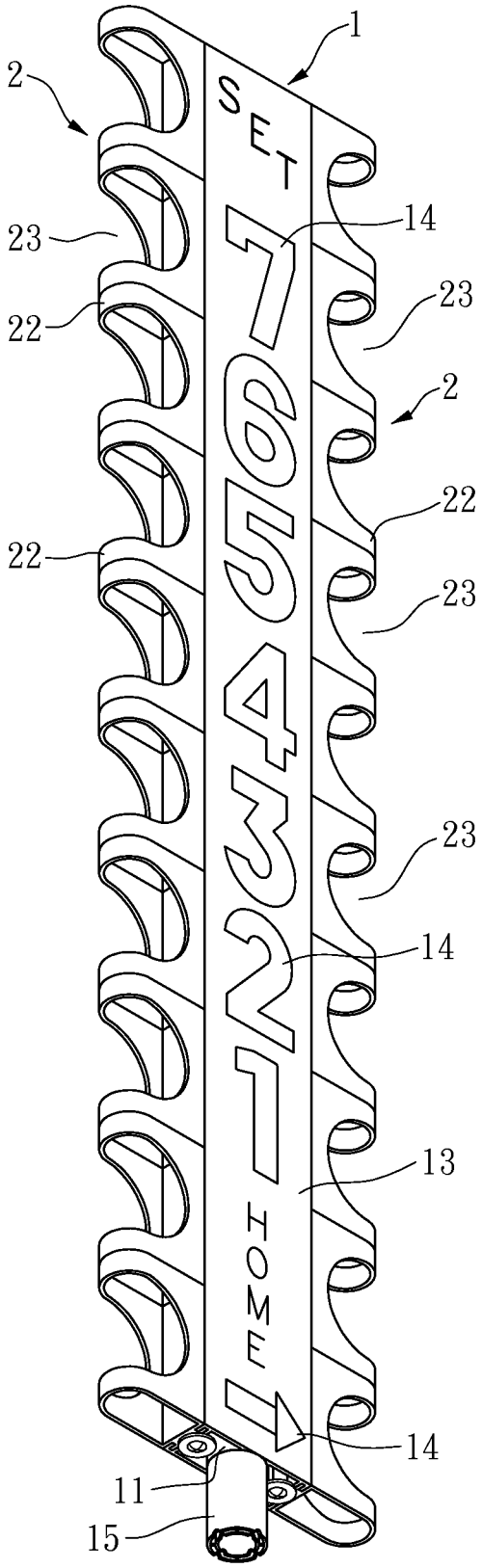
FIG. 1 is a three-dimensional view of the invention.
Figure 2:
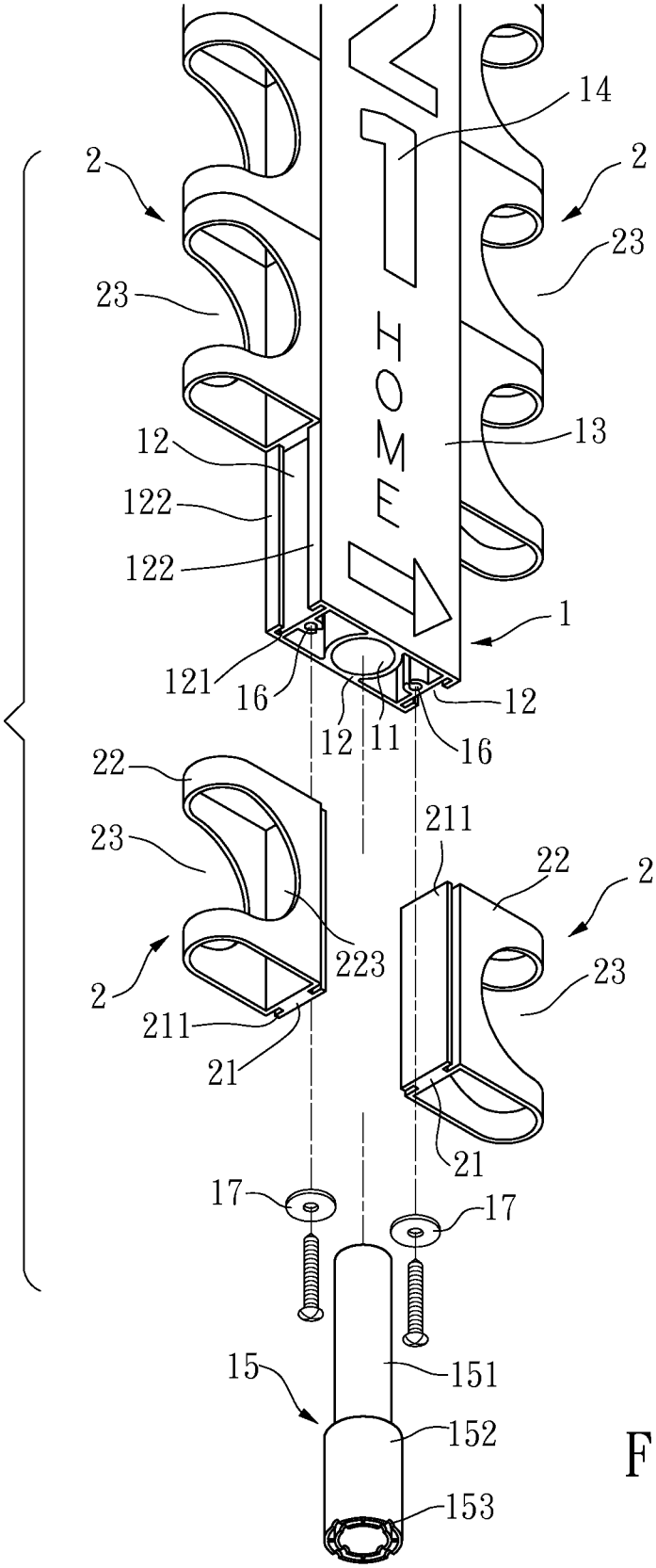
FIG. 2 is a three-dimensional exploded view of part of the invention.
Figure 3:
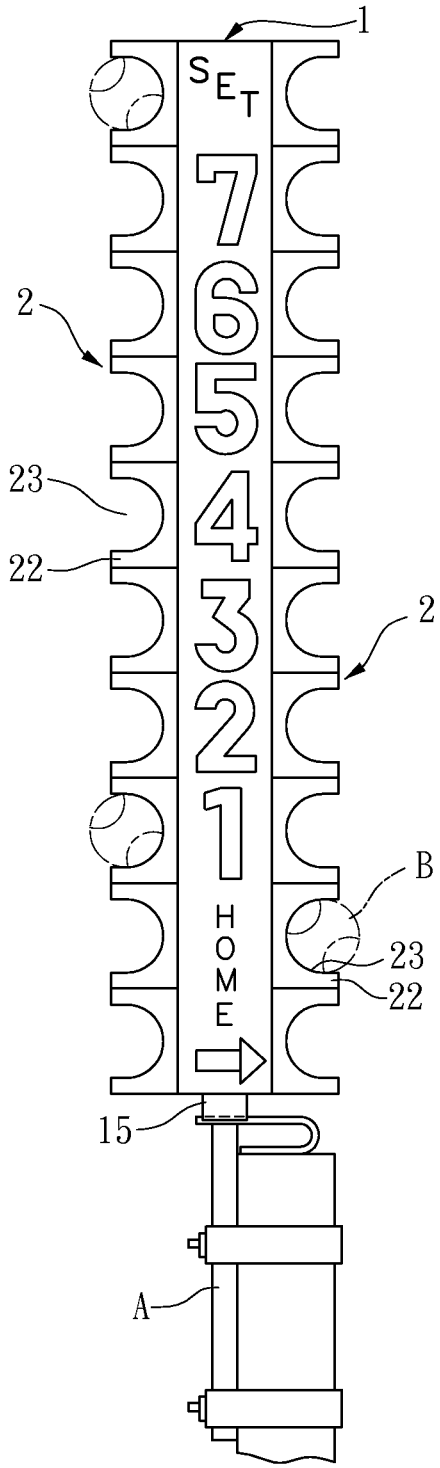
FIG. 3 is a schematic view of the invention in use.
Figure 4:
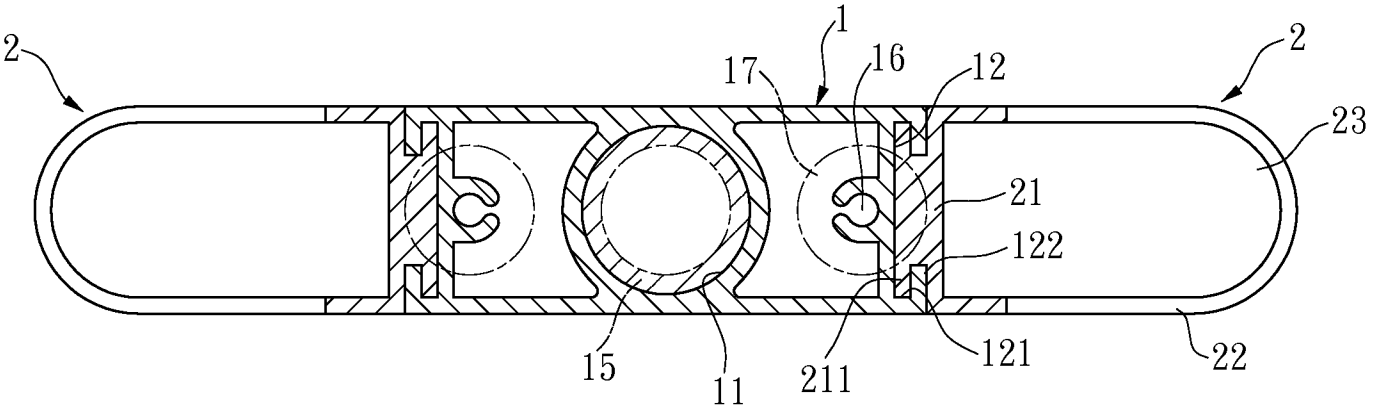
FIG. 4 is a cross-sectional view of the invention after assembly.

The present invention will be apparent from the following detailed description, which proceeds with reference to the accompanying drawings, wherein the same references relate to the same elements.

As illustrated in FIGS. 1 to 4, the invention includes a body 1 and several ball blocks 2. The body 1 is a long rectangular body. One end of the long axis thereof has a supporting part 11 mounted with an axis base 15 for pivotal connection of a supporting bar A. The body 1 can rotate with respect to the supporting bar A. Both sides supporting part 11 are formed respectively with an accommodating recess 12 on the body 1. Each of the accommodating recesses 12 extends along the long axis of the body 1. The two side surfaces of the body 1 next to each of the accommodating recesses 12 have a displaying surface 13, respectively. Each of the displaying surfaces 13 has several marks 14 for score display.

In this embodiment, the body 1 is prepared by aluminum extrusion forming. Each of the accommodating recesses 12 on both sides of the body 1 is formed by extending from each of the displaying surfaces 13 outward a sidewall 121 and extending w wing 122 from each of the sidewalls 121 oppositely. The supporting part 11 of the body 1 is a circular hole for mounting the axis base 15. The axis base 15 is a cylinder, one end of which has a mounting part 151 for mounting the supporting part 11 and the other end thereof has a pivotal connecting part 152 for pivotal connection of the supporting bar A. The end surface of the pivotal connecting part 152 is divided equally into several recesses 153 for positioning as the body 1 rotates. Of course, the accommodating recesses 12 and the circular supporting part 11 can be integrally formed with the body 1 from aluminum extrusion to reduce the manufacturing complication.

The ball block 2 has a connecting base 21 and a ball base 22 connected to the connecting base 21. Several ball blocks 2 are mounted in sequence in the accommodating recesses 12 on both sides of the body 1 via the connecting bases 21. The ball base 22 of the ball block 2 has a concave ball area 23 on the side opposite to the connecting base 21. Each of the ball areas can hold a ball B. Each of the ball areas 23 corresponds to the marks 14 of the displaying surfaces 13 of the body 1.

In this embodiment, the ball block 2 is prepared by plastic ejection forming. The connecting base 21 is protruded with a track 211 on the side of the ball base 22 in order to slide between the bottom of the accommodating recesses 12 of the body and the two wings 122. The interior of the ball base 22 is hollow, in connection with the ball area 23, to form an area that can hold the ball B.

During assembly, the track 211 of the connecting base 21 enables the ball blocks 2 to be slid into and get installed in the accommodating recesses 12 on both sides of the body 1. In order for each of the ball block 2 not to fall off the accommodating recesses 12, both ends of the long axis of the body 1 have a fixing part 16, respectively, corresponding to the accommodating recesses 12. Each of the fixing parts 16 has a blocking element 17 to block the outermost ball block 2 of each of the accommodating recesses 12.

Figure 5:
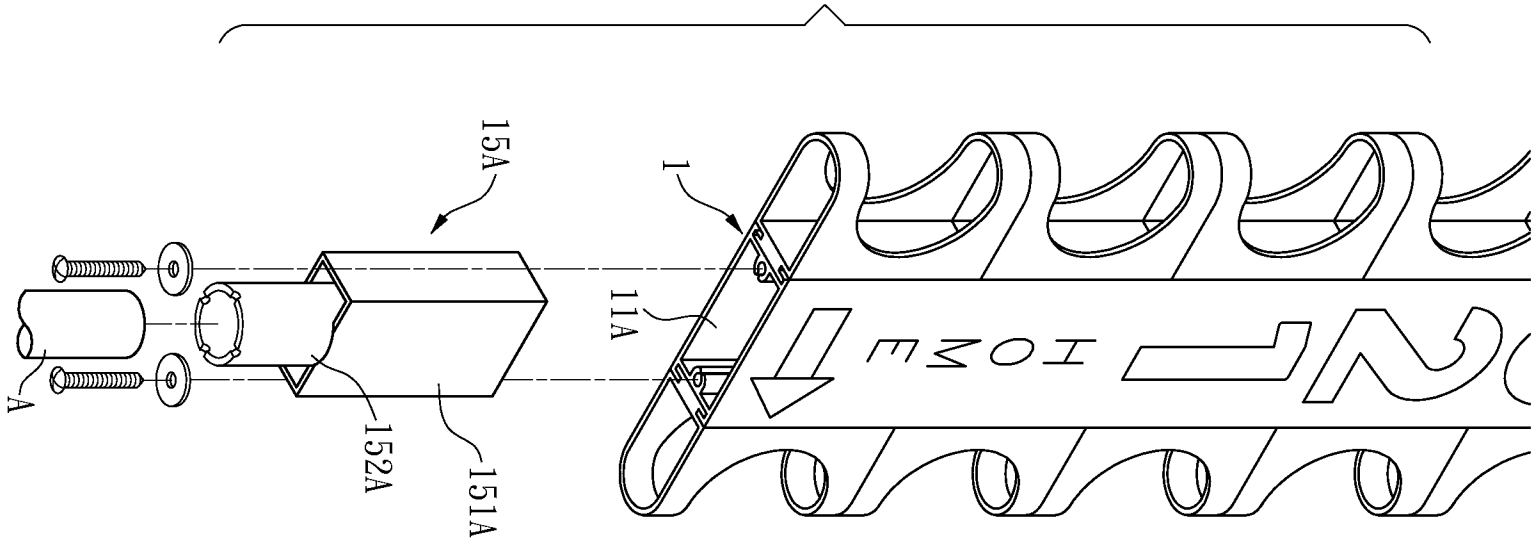
FIG. 5 is a three-dimensional exploded view of the second embodiment of the invention.

Of course, the invention has many other embodiments that only vary in details. Please refer to FIG. 5 for a second embodiment. The supporting part 11A of the body 1 is a rectangular hole for mounting the axis base 15A. The mounting part 151A on one end of the axis base 15A is a rectangular block to be mounted in the supporting part 11A. The pivotal connecting part 152A on the other end of the axis base 15A is for pivotal connection of the supporting bar A. Likewise, the body 1 can rotate with respect to the supporting bar A.

Figure 6:
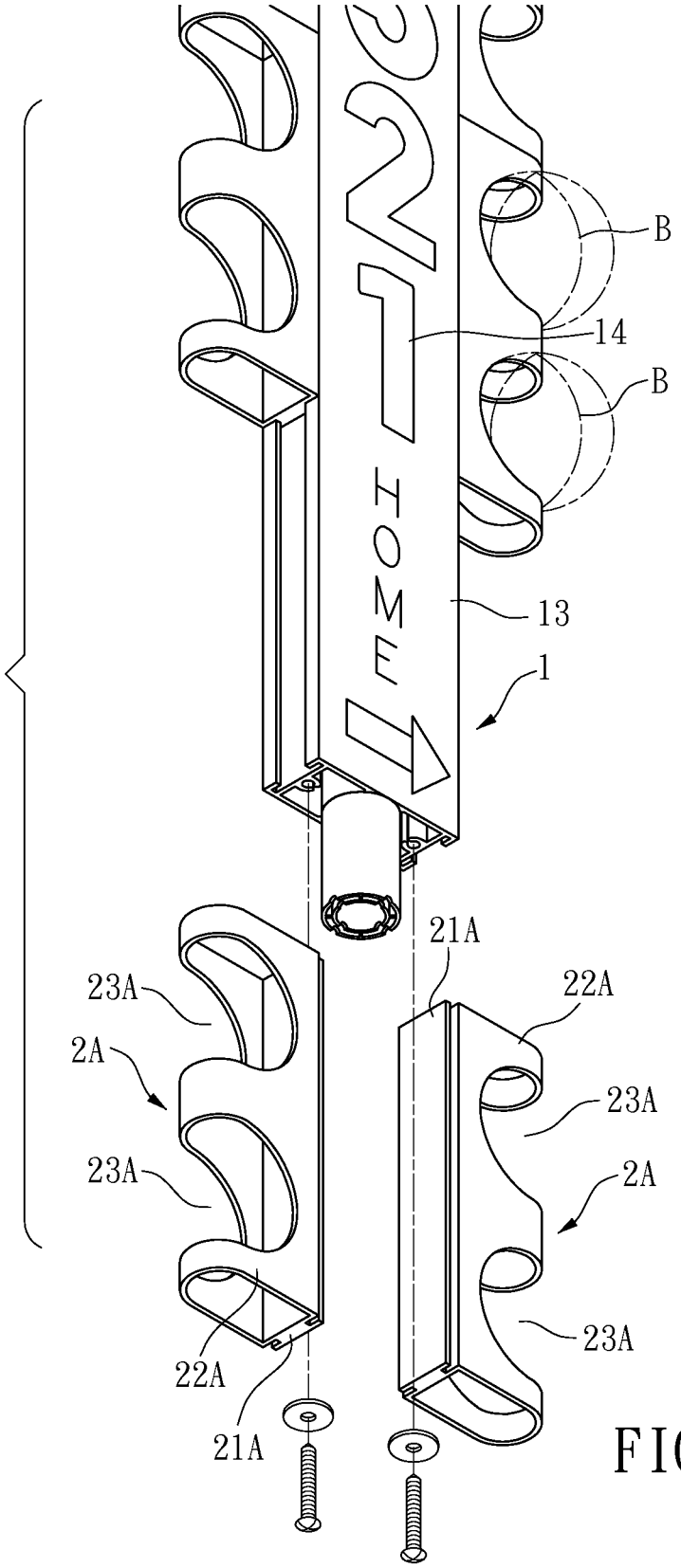
FIG. 6 is a three-dimensional exploded view of the third embodiment of the invention.
Figure 7:
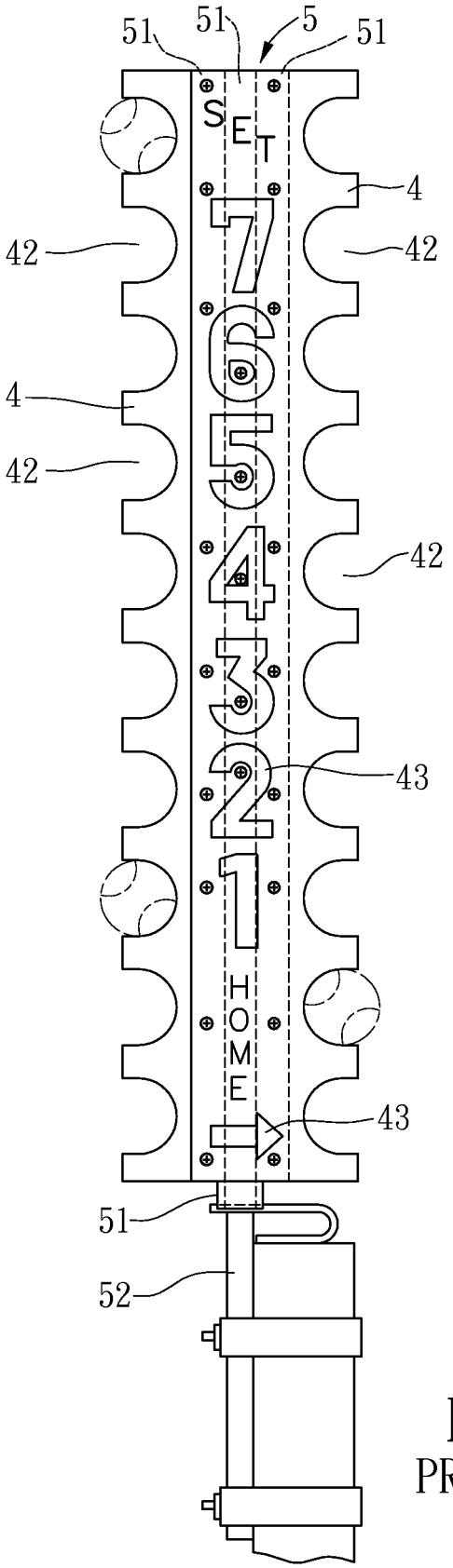
FIG. 7 PRIOR ART
FIG. 7 is a three-dimensional view of a conventional score device.
Figure 8:
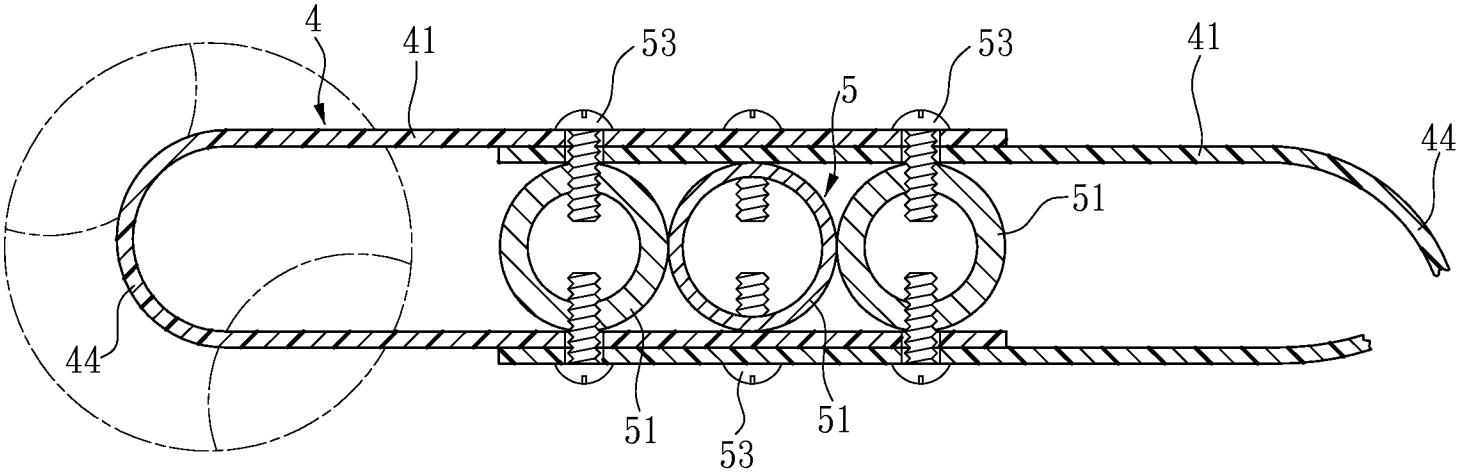
FIG. 8 PRIOR ART
FIG. 8 is a cross-sectional view of a conventional score device after assembly.

Please refer to FIG. 6 for a third embodiment. The ball base 22A of the ball block 2A has two concave ball areas 23A on the side opposite to the connecting base 21A. Each of the ball areas 23A can hold a ball B, respectively. Each of the ball areas 23A also corresponds to each of the marks 14 of the displaying surface 13 of the body 1.

The ball block 2 of the invention can be inserted into the accommodating recess 12 of the body 1 via the track 211 and is blocked by the blocking element 17. Such assembly is fairly easy and convenient. Moreover, each broken ball block 2 can be replaced individually. That is, when the ball area 23 of one of the blocks 2 is broken, that particular ball block 2 is replaced without affecting the other ball blocks 2. This achieves the goals of easy assembly, easy replacement, and low maintenance costs.

Furthermore, the body 1 is prepared by aluminum extrusion forming. Therefore, the accommodating recesses 12, the supporting part 11, and the fixing part 16 are integrally formed during the aluminum extrusion to reduce complexity in manufacturing. The ball block 2 is made by plastic ejection forming. Thus, the connection between the ball base 22 and the ball area 23 is sturdier, rendering a longer lifetime.

Although the invention has been described with reference to specific embodiments, this description is not meant to be construed in a limiting sense.

Various modifications of the disclosed embodiments, as well as alternative embodiments, will be apparent to people skilled in the art. Therefore, it is contemplated that the appended claims will cover all modifications that fall within the true scope of the invention.

I claim:

1. A tennis score device comprising:

a long rectangular body, one end of whose long axis has a supporting part for pivotal connection of a supporting bar so that the body rotates with respect to the supporting bar; wherein a first pair of opposing sides of the supporting part on the body each have an accommodating recess extending along the long axis direction of the body and a second pair of opposing sides, each having a score display surface;

a plurality of ball blocks, each having a proximal side and a distal side; the proximal side shaped to form a connecting base and the distal side shaped to form a ball base; wherein each of the ball blocks is slidably captured in the accommodating recesses on both sides of the body via the connecting base and vertically stacked on top of one another, the ball base of each of the ball blocks forming a concave ball-shaped recess for holding a ball, and a plurality of the ball-shaped recesses are substantially horizontally adjacent to score indicia on the score display surfaces of the body; whereby placement of a ball in a ball-shaped recess helps to keep score.

2. The tennis score device of claim 1, wherein the accommodating recesses on both sides of the body are formed by extending a sidewall outward from each of the displaying surfaces and extending a wing from each of the sidewalls toward the other sidewall, and the connecting base on each ball block comprises one or more protrusions shaped to match the accommodating recesses and be slidably captured thereby.

3. The tennis score device of claim 1, wherein the supporting part of the body is a hole for mounting an axis base, one end of the axis base has a mounting part to be mounted into the supporting part, and the other end of the axis base has a pivotal connecting part for pivotal connection of the supporting bar.

4. The tennis score device of claim 3, wherein the end surface of the pivotal connecting part of the axis base is divided equally into several recesses for positioning as the body rotates.

5. The tennis score device of claim 1, wherein both ends of the long axis of the body have a fixing part respectively corresponding to each of the accommodating recesses, and each of the fixing parts has a blocking element to block the outermost individual ball block of the corresponding accommodating recess, whereby the ball blocks are retained in the accommodating recess.

6. The tennis score device of claim 1, wherein the ball base of each ball block has two concave ball areas on the side opposite to the connecting base for holding a ball, each ball area being substantially horizontally adjacent to a score indicia.

7. The tennis score device of claim 1, wherein the number of ball blocks on each side of the body is the same.

* * * * *